US010570653B2

(12) United States Patent
Gruber et al.

(10) Patent No.: US 10,570,653 B2
(45) Date of Patent: Feb. 25, 2020

(54) VEHICLE DOOR CHECKER

(71) Applicant: Multimatic, Inc., Markham (CA)

(72) Inventors: Rudolf Gruber, Uxbridge (CA); David Edward Carswell, Aurora (CA)

(73) Assignee: Multimatic Inc., Markham (CA)

( * ) Notice: Subject to any disclaimer, the term of this patent is extended or adjusted under 35 U.S.C. 154(b) by 208 days.

(21) Appl. No.: 15/524,407

(22) PCT Filed: Nov. 6, 2015

(86) PCT No.: PCT/US2015/059495
§ 371 (c)(1),
(2) Date: May 4, 2017

(87) PCT Pub. No.: WO2017/078737
PCT Pub. Date: May 11, 2017

(65) Prior Publication Data
US 2018/0283061 A1 Oct. 4, 2018

(51) Int. Cl.
*E05C 17/20* (2006.01)

(52) U.S. Cl.
CPC ..... *E05C 17/203* (2013.01); *E05Y 2900/531* (2013.01)

(58) Field of Classification Search
CPC . E05C 17/203; E05Y 2900/531; Y10T 16/61; Y10T 16/6295; Y10T 16/625
See application file for complete search history.

(56) References Cited

U.S. PATENT DOCUMENTS 4,833,755 A 5/1989 Bonin
5,862,570 A * 1/1999 Lezuch ..... E05C 17/085 16/82
7,469,944 B2 * 12/2008 Kitayama ..... E05C 17/203 16/86 A (Continued)

FOREIGN PATENT DOCUMENTS

AT 350403 B 5/1979
CN 201184083 Y 1/2009

(Continued)

OTHER PUBLICATIONS

International Preliminary Report on Patentability for International Application No. PCT/US2015/059495 dated May 17, 2018.

(Continued)

*Primary Examiner* — Victor D Batson
*Assistant Examiner* — Matthew J Sullivan
(74) *Attorney, Agent, or Firm* — Carlson, Gaskey & Olds, P.C.

(57) ABSTRACT

A door checker includes a housing which has a base from which first and second opposing flanges extend. First and second guide pins are spaced apart from one another and are interconnected to the first and second flanges. A check arm extends through the base and is arranged between the first and second guide pins. The check arm is configured to move relative to the housing and includes a profile that corresponds to a variable door holding force. A bearing member is arranged on one side of the check arm and is slidably supported by the first and second guide pins. The bearing member coacts with the profile.

20 Claims, 3 Drawing Sheets

(56) References Cited

U.S. PATENT DOCUMENTS

| | | | | |
|---|---|---|---|---|
| 7,908,709 | B2 * | 3/2011 | Cruz | E05C 17/203 16/86 B |
| 9,003,604 | B2 * | 4/2015 | Matsuki | E05F 5/025 16/86 C |
| 2004/0075285 | A1 * | 4/2004 | Murayama | E05C 17/203 292/265 |
| 2006/0267354 | A1 * | 11/2006 | Petrus Van Den Heuvel | E05C 17/203 292/262 |
| 2008/0209675 | A1 | 9/2008 | Sempert et al. | |
| 2010/0154163 | A1 * | 6/2010 | Hoffmann | E05C 17/203 16/85 |

FOREIGN PATENT DOCUMENTS

| | | | | |
|---|---|---|---|---|
| CN | 103737665 | A | 4/2014 | |
| CN | 204002171 | U | 12/2014 | |
| DE | 4325550 | C2 | 3/2003 | |
| DE | 102004034259 | A1 | 2/2005 | |
| DE | 202011051957 | U1 | 1/2012 | |
| DE | 202016104014 | U1 * | 9/2016 | E05C 17/22 |
| EP | 0165693 | A2 | 12/1985 | |
| EP | 2682547 | A1 | 1/2014 | |
| FR | 849440 | A | 11/1939 | |
| FR | 2957110 | A1 | 2/2012 | |
| JP | 2581536 | Y2 | 9/1998 | |
| JP | 2001012127 | A | 1/2001 | |
| JP | 2002129818 | A | 5/2002 | |
| JP | 2004-44187 | A | 2/2004 | |
| JP | 2006-97402 | A | 4/2006 | |
| JP | 2006291672 | A | 10/2006 | |
| JP | 2007239339 | A | 9/2007 | |
| JP | 2014-34865 | A | 2/2014 | |
| JP | 2014-214487 | A | 11/2014 | |
| JP | 2014234699 | A | 12/2014 | |
| KR | 100901313 | B1 | 6/2009 | |
| KR | 1020110089474 | A | 8/2011 | |
| KR | 1020130042407 | A | 4/2013 | |
| WO | 2006049540 | A1 | 5/2006 | |

OTHER PUBLICATIONS

International Search Report and Written Opinion for PCT/ US2015/059495 dated Aug. 29, 2016.

Russian Search Report for Russian Application No. 2018120493 completed Oct. 18, 2018.

Japanese Office Action for Japanese Application No. 2018-521387 dated Apr. 2, 2019.

* cited by examiner

VEHICLE DOOR CHECKER

BACKGROUND

This disclosure relates to a door checker used for automotive vehicle doors.

A door checker is commonly used in an automotive vehicle to hold a door in one of several discrete open positions. The door checker housing is mounted within a door cavity, and a check arm extends through the housing and attaches at one end to a vehicle pillar. The check arm includes a profile with a groove that has a variable height and several spaced apart pockets that correspond to the discrete open positions. A pair of spring loaded balls is arranged within the housing and cooperates with opposing sides of the check arm to provide a desired lateral and longitudinal holding force on the check arm.

In one prior art arrangement, the housing is provided by two stamped sheet metal housing portions that are secured to one another to provide a six-sided box-like structure enclosing the balls and springs. This configuration has been widely used and provides a robust door checker design, but is relatively heavy.

SUMMARY

In one exemplary embodiment, a door checker includes a housing which has a base from which first and second opposing flanges extend. First and second guide pins are spaced apart from one another and are interconnected to the first and second flanges. A check arm extends through the base and is arranged between the first and second guide pins. The check arm is configured to move relative to the housing and includes a profile that corresponds to a variable door holding force. A bearing member is arranged on one side of the check arm and is slidably supported by the first and second guide pins. The bearing member coacts with the profile.

In a further embodiment of the above, another bearing member is arranged on another side of the check arm. The other bearing member coacts with another profile on the other side of the check arm.

In a further embodiment of any of the above, the bearing member includes a bearing case with an aperture within which a ball is arranged. The ball engages the profile.

In a further embodiment of any of the above, a spring is arranged between the first flange and the bearing case and is configured to urge the ball into engagement with the profile to provide the variable door holding force.

In a further embodiment of any of the above, the profile is provided by a groove that has a variable height. The bearing case is configured to slide along the first and second guide pins as the ball slides along the groove.

In a further embodiment of any of the above, the aperture includes a perimeter with inwardly extending tabs that provide an opening that is smaller than a diameter of the ball, retaining the ball in the bearing case.

In a further embodiment of any of the above, the aperture includes slots filled with a lubricant configured to lubricate the ball.

In a further embodiment of any of the above, the bearing case includes first and second elongated slots respectively on first and second opposing ends. The first and second slots respectively receive the first and second guide pins.

In a further embodiment of any of the above, the first and second slots have an arcuate cross-section and are open on one side.

In a further embodiment of any of the above, each of the first and second slots includes pockets filled with a lubricant configured to lubricate the first and second guide pins.

In a further embodiment of any of the above, a clevis is pivotally attached to one end of the check arm. A stop is provided at the other end of the check arm on a side of the bearing case with an outer face having spaced apart protrusions configured to laterally locate the stop with the check arm in a fully extended position.

In a further embodiment of any of the above, the bearing case includes an inner face spaced from the base in a first position. The guide pins are configured to flex and permit the inner face to engage the base in a second position in which the stop engages the outer face.

In a further embodiment of any of the above, the base includes spaced apart lips. The bearing case includes opposing edges that adjoin the inner face near the lips. The lips are configured to arrest lateral motion of the bearing case with respect to the housing in the second position.

In a further embodiment of any of the above, the housing includes studs configured to secure the door checker to a door.

In a further embodiment of any of the above, each of the first and second guide pins include swaged ends that secure the first and second guide pins to the first and second flanges.

In another exemplary embodiment, a method of holding door in a desired open position. The method comprising the steps of sliding a check arm profile relative to a ball to vary a holding force and sliding a bearing case along a guide pin in a direction transverse to the check arm profile in response to the ball sliding step.

In a further embodiment of any of the above, the bearing case includes a ball that rides along a groove in the check arm that provides the profile.

In a further embodiment of any of the above, there is a housing that supports a pair of guide pins that slidably support the bearing case.

In a further embodiment of any of the above, the method includes the step of engaging the bearing case with a check arm stop which deflects the guide pin and moves the bearing case into engagement with the housing.

In a further embodiment of any of the above, the method includes the step of laterally locating the check arm stop with protrusions on the bearing case.

In another exemplary embodiment, a door checker includes a housing which includes a base from which first and second opposing flanges extend. The housing is substantially open on three sides. A guide element is interconnected to the first and second flanges. A check arm extends through the base and is configured to move relative to the housing. The check arm includes a profile that corresponds to a variable door holding force. A bearing member is arranged on one side of the check arm and is slidably supported by the guide element. The bearing member coacts with the profile. The profile has a variable height. The bearing member is configured to slide along the guide element as the bearing member coacts with the profile.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
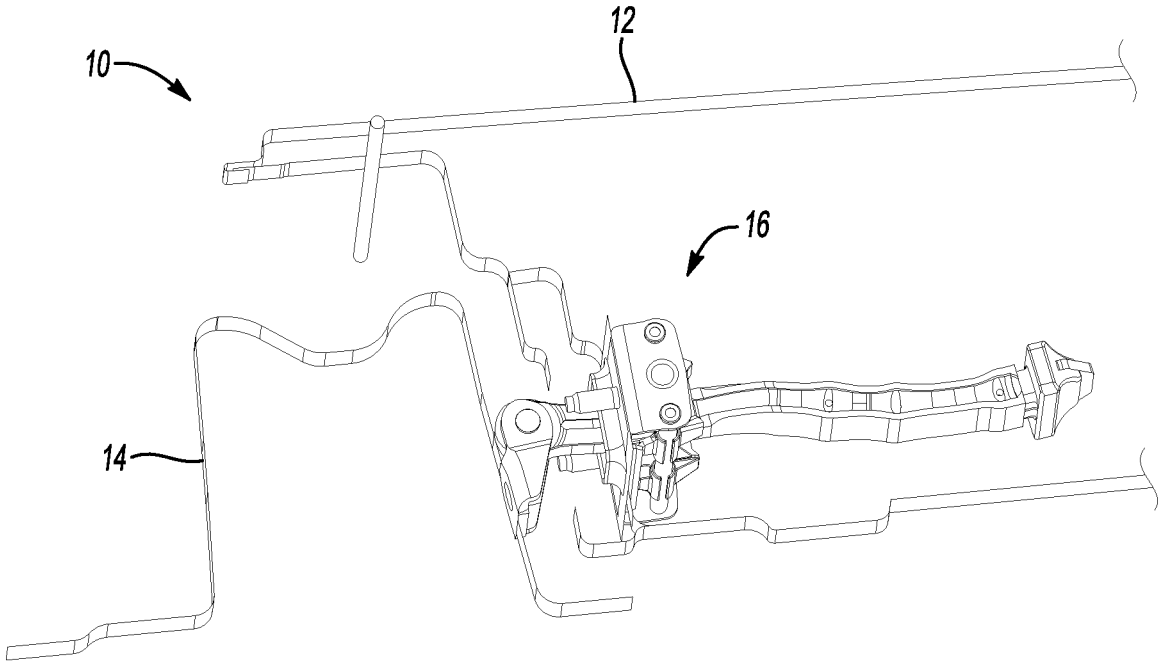
FIG. 1 is a perspective view of a door check arranged within a door cavity and secured to a vehicle pillar.

A portion of a vehicle 10 is illustrated in FIG. 1. The vehicle 10 includes a door 12 adjacent to a pillar 14 that provides a door opening. A door checker 16 is arranged within a door cavity and is interconnected between the door 12 and pillar 14. The door checker 16 provides discrete open positions in which the door is maintained in a desired open position by a holding force provided by the door checker.

Figure 2A:
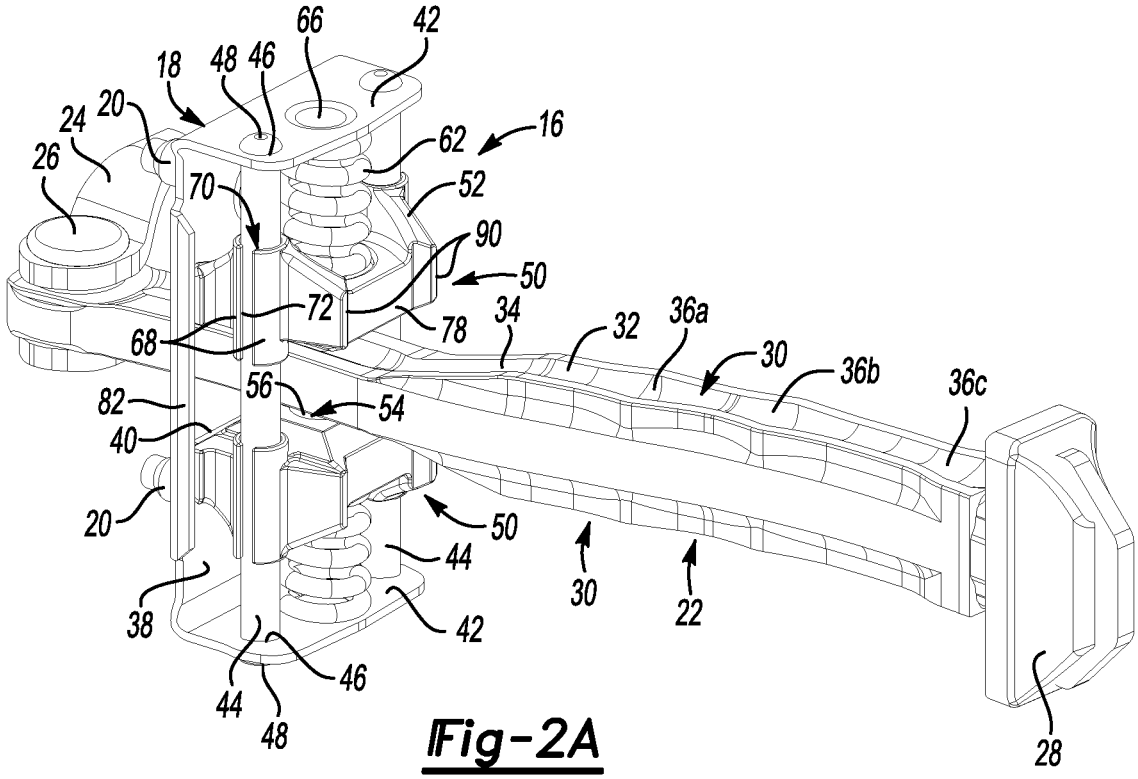
FIG. 2A is an enlarged perspective view of the door checker shown in FIG. 1.
Figure 2B:
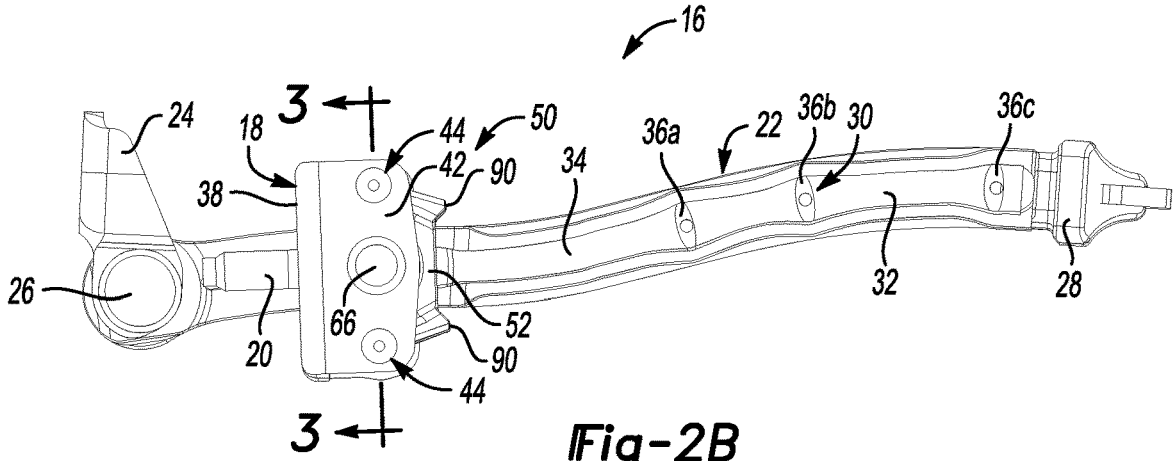
FIG. 2B is a top elevational view of the door checker shown in FIG. 2A.
Figure 2C:
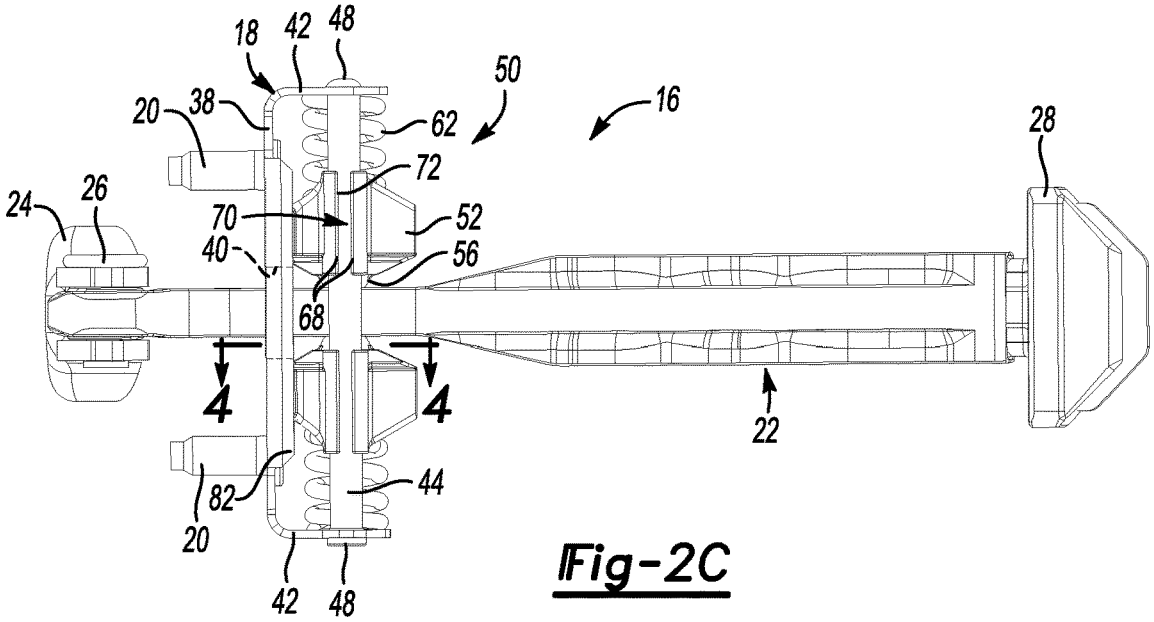
FIG. 2C is side elevational view of the door checker shown in FIG. 2A.

Referring to FIGS. 2A-2C, the door checker 16 includes a stamped sheet metal C-shaped housing 18 that is substantially open on three sides. Fasteners 20, for example, studs, are mounted to the housing 18 and used to secure the door checker 16 to the door 12 with nuts. A check arm 22 extends through the housing 18 and includes a clevis 24 secured to one end by a pivot pin 26. The clevis 24 is secured to the pillar 14. A stop 28 is provided at an end of the check arm 22 opposite the clevis 24 to limit the range of motion when the door is opened.

In the example illustrated, the check arm 22 is a plastic material overmolded about a metal core. The check arm 22 includes a profile 30 arranged on each of opposing sides and provided by a groove 32. The groove 32 includes a ramp 34 that increases the spring pre-load as the door 12 is opened. Multiple pockets 36*a*, 36*b*, 36*c* are provided in the groove 32 and correspond to discrete door open positions at a predetermined holding force.

The housing 18 includes a base 38 having an opening 40 through which the check arm 22 extends. Opposing flanges 42 are integral with and extend from the base 38 in the illustrated embodiment. A guide element, such as a pair of guide pins 44, are interconnected to the flanges 42 and spaced from the base 38. In the example, the guide pins 44 extend through holes 46 in the flanges 42 and are retained to the housing 18 by enlarged ends 48, one end of which may be swaged during assembly.

Figure 3:
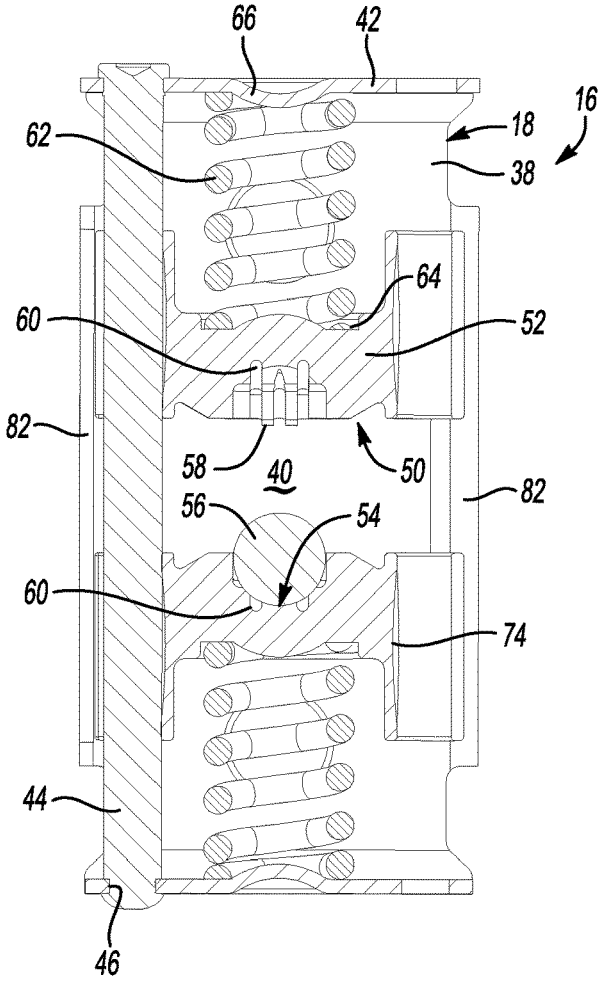
FIG. 3 is a cross-sectional view taken along line 3-3 in FIG. 2B.
Figure 4:
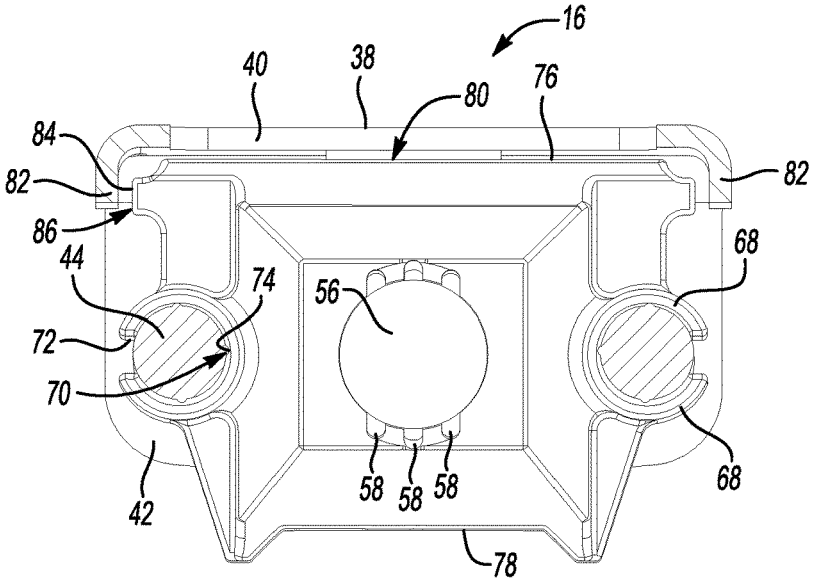
FIG. 4 is a cross-sectional view taken along line 4-4 in FIG. 2C.

Referring to FIGS. 3 and 4, a bearing member 50 is provided between each flange 42 and the check arm 22 to exert the holding force on the groove 32. In the example, each bearing member 50 is provided by a plastic bearing case 52 that has an aperture 54 which receives a metallic ball 56. The bearing case 52 includes tabs 58 at a perimeter of the aperture 54 that provide an opening that is slightly smaller than a diameter of the ball 56, shown in FIGS. 3 and 4. Thus, the tabs 58 retain the balls 56 in their respective apertures 54 during assembly. One or more slots 60 are provided in the apertures 54 and are filled with a lubricant to lubricate the balls 56 during use.

A spring 62 is mounted between each flange 42 and each bearing case 52. In the example, the bearing cases 52 include a recess 64, and the flange 42 provides a dimple 66. The recess 64 and dimple 66 locate and retain the position of the spring 62 during operation.

Each opposing end of the bearing cases 52 include curved walls 68 providing an arcuate elongated slot 70 having a C-shaped cross section, best shown in FIG. 4. The elongated slot 70 has a diameter that is slightly smaller than an outer diameter of the guide pins 44. The elongated slot 70 includes an opening 72 that enables the curved walls 68 to flex and accommodate the guide pins 44 during assembly, which provides elastic tolerance compensation and prevents noise by eliminating free play. Referring to FIGS. 3 and 4, one or more pockets 74 may be provided in the elongated slot 70 and filled with lubricant. The pockets 74 are disposed interiorly of the edges of the elongated slot 70 to better retain the lubricant.

Each ball 56 is positioned within its respective groove 32 on opposing sides of the check arm 22. When the door is opened and closed during use, the balls 56 glide along the grooves 32. Due to the varying height provided by the profile 30, the bearing cases 52 will slide along the guide pins 44 to provide a variable door holding force.

Referring to FIG. 4, the bearing case 52 includes inner and outer faces 76, 78. The inner face 84 is spaced from the base 38 to provide a gap 80. Edges 84 of the bearing case 52 are arranged adjacent to the inner face 76 and are spaced apart from lateral lips 82 that extend from the base 38 parallel to the guide pins 44. A space 86 is provided between each of the edges 84 and the nearby lip 82. Thus, the bearing cases 52 do not contact the housing 18 during normal use.

When the door is extended to a fully open position, the stop 28 may engage the outer face 78 of the bearing cases 52, which causes the guide pins 44 to deflect and permit the inner face 76 to engage the base 38 and possibly the lips 82 if the bearing cases 52 move laterally. Deflection of the guide pins 44 allows to transfer load from the stop 28 through the bearing cases 52 and housing 18 to the door 12, which significantly increases the load caring capability of the door check. The gap 80 and spaces 86 are relatively small, limiting the deflection of the guide pins 44.

Figure 2D:
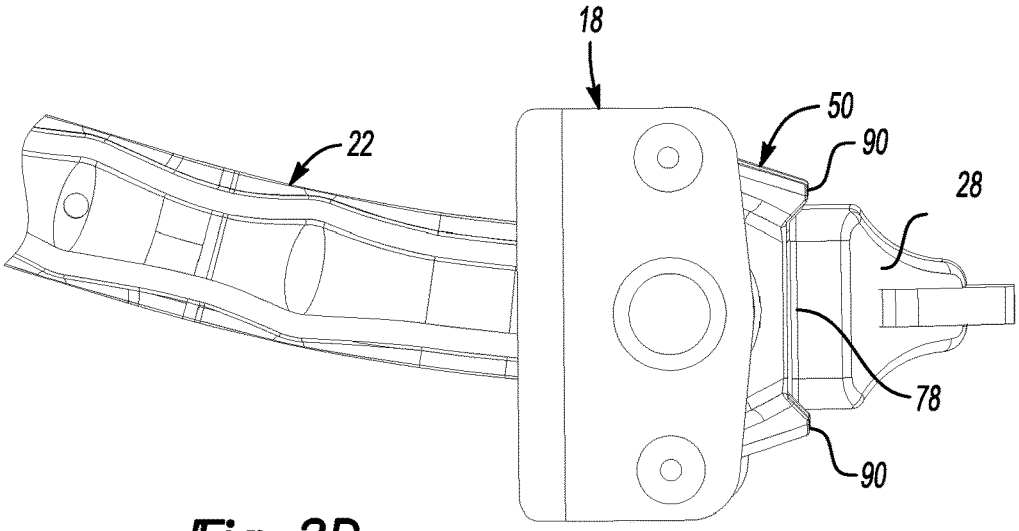
FIG. 2D is a top elevational view of the door checker shown in FIG. 2A with a check arm fully extended when the door is in a fully open position.

As shown in FIGS. 2A, 2B and 2D, the bearing cases 52 include spaced apart protrusions 90 adjacent to the outer face 78. The protrusions 90 laterally locate the stop 28 when the check arm 22 is fully extended (FIG. 2D) to prevent high loads, for example, 10 kN, on the stop 28 from pushing the stop 28 laterally off of the bearing cases 52.

The disclosed door checker 16 provides a robust design that is lighter weight than prior door checker designs.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. A door checker comprising:

a housing which includes a base from which first and second opposing flanges extend;

first and second guide pins which are spaced apart from one another and are interconnected to the first and second flanges;

a check arm which extends through the base and is arranged between the first and second guide pins, the check arm being configured to move relative to the housing and including a profile that corresponds to a variable door holding force; and a bearing member which is arranged on one side of the check arm and is slidably supported on the first and second guide pins, wherein the bearing member includes a bearing case with an aperture within which a ball is arranged, the ball engages the profile, and the bearing case is configured to slide on the first and second guide pins in response to movement of the check arm relative to the bearing member.

2. The door checker according to claim 1, comprising another bearing member arranged on another side of the check arm, and the other bearing member coacts with another profile on the other side of the check arm.

3. The door checker according to claim 1, comprising a spring arranged between the first flange and the bearing case and configured to urge the ball into engagement with the profile to provide the variable door holding force.

4. The door checker according to claim 3, wherein the profile is provided by a groove that has a variable height, and the bearing case is configured to slide along the first and second guide pins as the ball slides along the groove.

5. The door checker according to claim 3, wherein the aperture includes a perimeter with inwardly extending tabs that provide an opening that is smaller than a diameter of the ball to retain the ball in the bearing case.

6. The door checker according to claim 5, wherein the aperture includes slots filled with a lubricant configured to lubricate the ball.

7. The door checker according to claim 1, wherein the bearing case includes first and second elongated slots respectively on first and second opposing ends, and the first and second slots respectively receive the first and second guide pins.

8. The door checker according to claim 7, wherein the first and second slots have an arcuate cross-section and are open on one side.

9. The door checker according to claim 7, wherein each of the first and second slots includes pockets filled with a lubricant configured to lubricate the first and second guide pins.

10. The door checker according to claim 1, wherein the housing includes studs configured to secure the door checker to a door.

11. The door checker according to claim 1, wherein each of the first and second guide pins includes swaged ends securing the first and second guide pins to the first and second flanges.

12. A door checker comprising:

a housing which includes a base from which first and second opposing flanges extend;

first and second guide pins which are spaced apart from one another and are interconnected to the first and second flanges;

a check arm which extends through the base and is arranged between the first and second guide pins, the check arm being configured to move relative to the housing and including a profile that corresponds to a variable door holding force; and a bearing member which is arranged on one side of the check arm and is slidably supported by the first and second guide pins, wherein the bearing member coacts with the profile, and the bearing case includes an inner face spaced from the base in a first position, and the guide pins are configured to flex and permit the inner face to engage the base in a second position in which a stop on the check arm engages the outer face.

13. The door checker according to claim 12, wherein the base includes spaced apart lips, and the bearing case includes opposing edges adjoining the inner face near the lips, and the lips are configured to arrest lateral motion of the bearing case with respect to the housing in the second position.

14. The door checker according to claim 12, comprising a clevis pivotally attached to one end of the check arm, and a stop is provided at the other end of the check arm on a side of the bearing case with an outer face having spaced apart protrusions configured to laterally locate the stop with the check arm in a fully extended position.

15. A method of holding door in a desired open position, the method comprising the steps of:

sliding a check arm profile relative to a ball to vary a holding force; and sliding a bearing case on a guide pin in a direction transverse to the check arm profile in response to the check arm profile sliding step, wherein the bearing case supports a ball.

16. The method according to claim 15, wherein the ball rides along a groove in the check arm profile.

17. The method according to claim 15, comprising a housing supporting a pair of guide pins that slidably support the bearing case in response to movement of the check arm relative to the bearing case.

18. The method according to claim 17, comprising the step of engaging the bearing case with a check arm stop which deflects the guide pin and moves the bearing case into engagement with the housing.

19. The method according to claim 18, comprising the step of laterally locating the check arm stop with protrusions on the bearing case.

20. A door checker comprising:

a housing which includes a base from which first and second opposing flanges extend, and the housing is substantially open on three sides;

a guide element which is interconnected to the first and second flanges;

a check arm which extends through the base and is configured to move relative to the housing, and the check arm includes a profile that corresponds to a variable door holding force; and a bearing member which is arranged on one side of the check arm and is slidably supported on the guide element, and the bearing member coacts with the profile and is configured to slide on the guide element in response to movement of the check arm relative to the bearing member, wherein the profile has a variable height, and the bearing member is configured to slide along the guide element as the bearing member coacts with the profile.

* * * * *